United States Patent [19]

Traill

[11] 4,319,419

[45] Mar. 16, 1982

[54] MOLDED PICTURE FRAME WITH ATTACHABLE DISPLAYS

[76] Inventor: Gerald L. Traill, 7225 Sears Rd., Horton, Mich. 49246

[21] Appl. No.: 174,165

[22] Filed: Jul. 31, 1980

[51] Int. Cl.[3] ..... G09F 1/12; A47G 1/16

[52] U.S. Cl. ..... 40/152.1; 40/154; 40/617

[58] Field of Search ..... 40/617, 606, 608, 152.1

[56] References Cited

U.S. PATENT DOCUMENTS

| | | | |
|---|---|---|---|
| D. 187,377 | 3/1960 | Huden | D29/20 |
| 1,467,140 | 9/1923 | De Meurisse | 40/617 |
| 3,117,672 | 7/1964 | Morletti | 211/87 |
| 3,327,414 | 6/1967 | Hill | 40/617 |
| 3,339,302 | 9/1967 | Mallory | 40/152 |
| 3,529,374 | 9/1970 | Spertus | 40/152 |
| 3,673,723 | 7/1972 | Lazar et al. | 40/617 |
| 3,673,724 | 7/1972 | Bell et al. | 40/152 |
| 4,017,989 | 4/1977 | Murray | 40/152 |
| 4,115,938 | 9/1978 | Belmuth et al. | 40/152 |

FOREIGN PATENT DOCUMENTS

| | | | |
|---|---|---|---|
| 21788 | of 1912 | United Kingdom | 40/617 |

*Primary Examiner*—Gene Mancene
*Assistant Examiner*—Wenceslao J. Contreras
*Attorney, Agent, or Firm*—Beaman & Beaman

[57] ABSTRACT

The invention pertains to a photograph display adapted to be mounted upon a wall consisting of a decorative support member from which a plurality of photograph display frames may be suspended in a selective pattern. The display frames adjacent the support member are removably connected thereto, and display frames are also suspended from the display frames immediately thereabove. The connection means for the display frames is modular to permit a selective assembly as desired.

2 Claims, 8 Drawing Figures

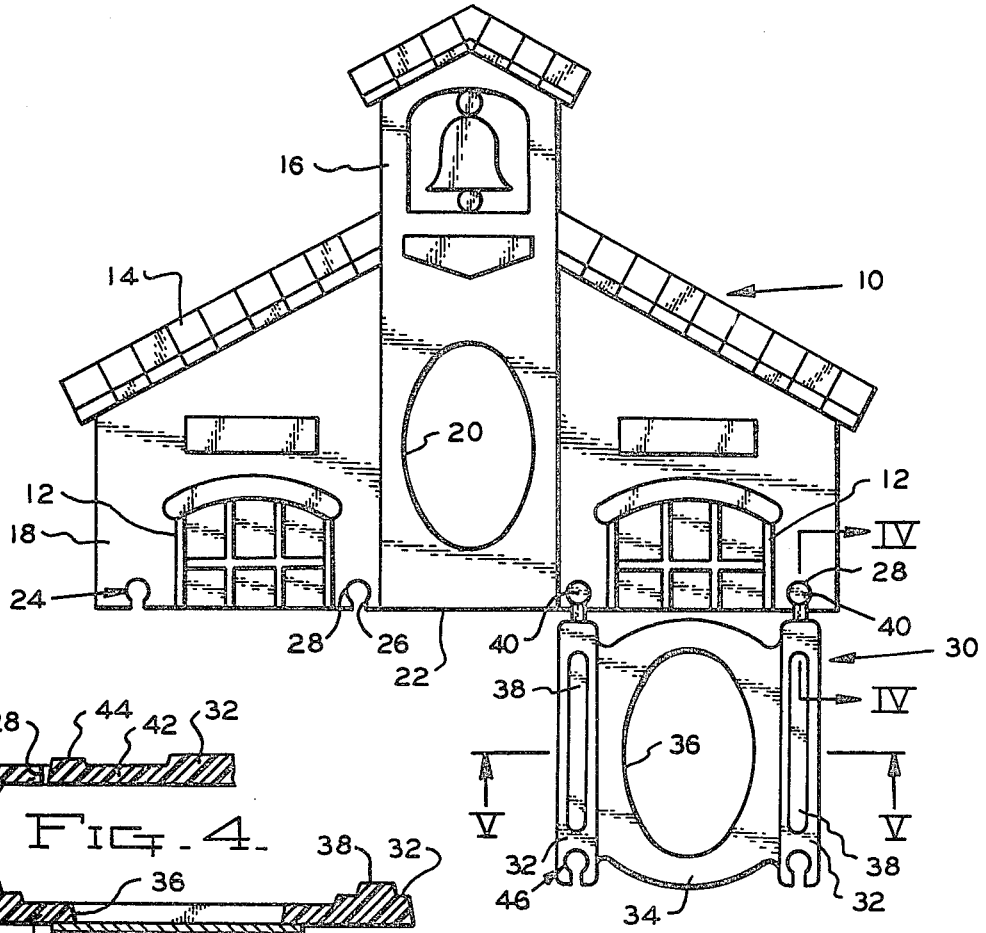
FIG. 1.
FIG. 4.
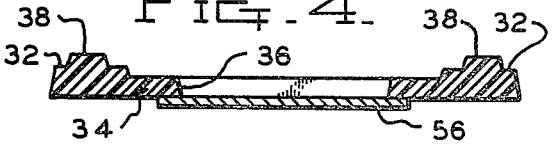
FIG. 5.
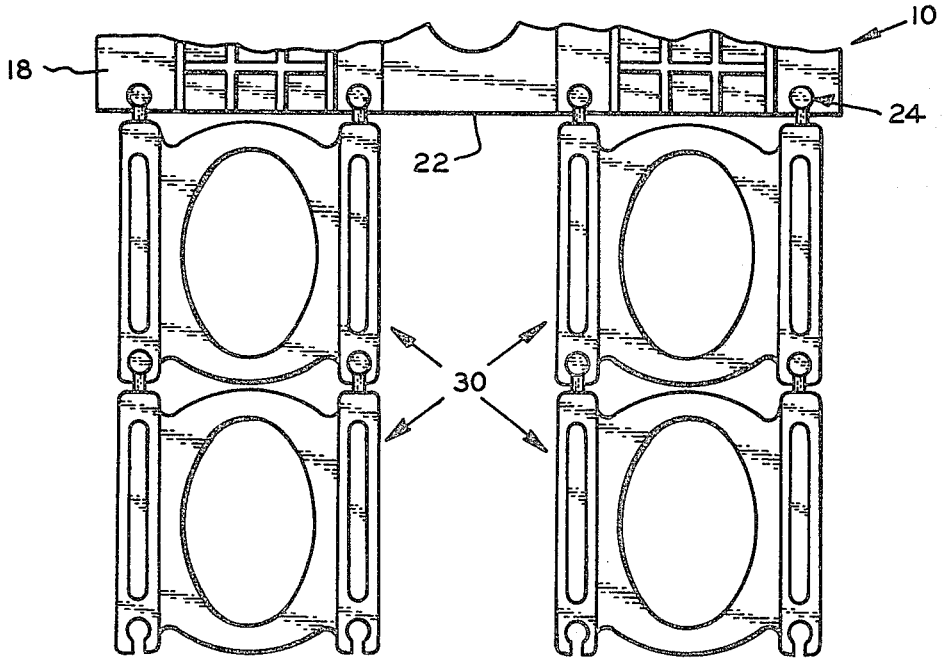
FIG. 8.

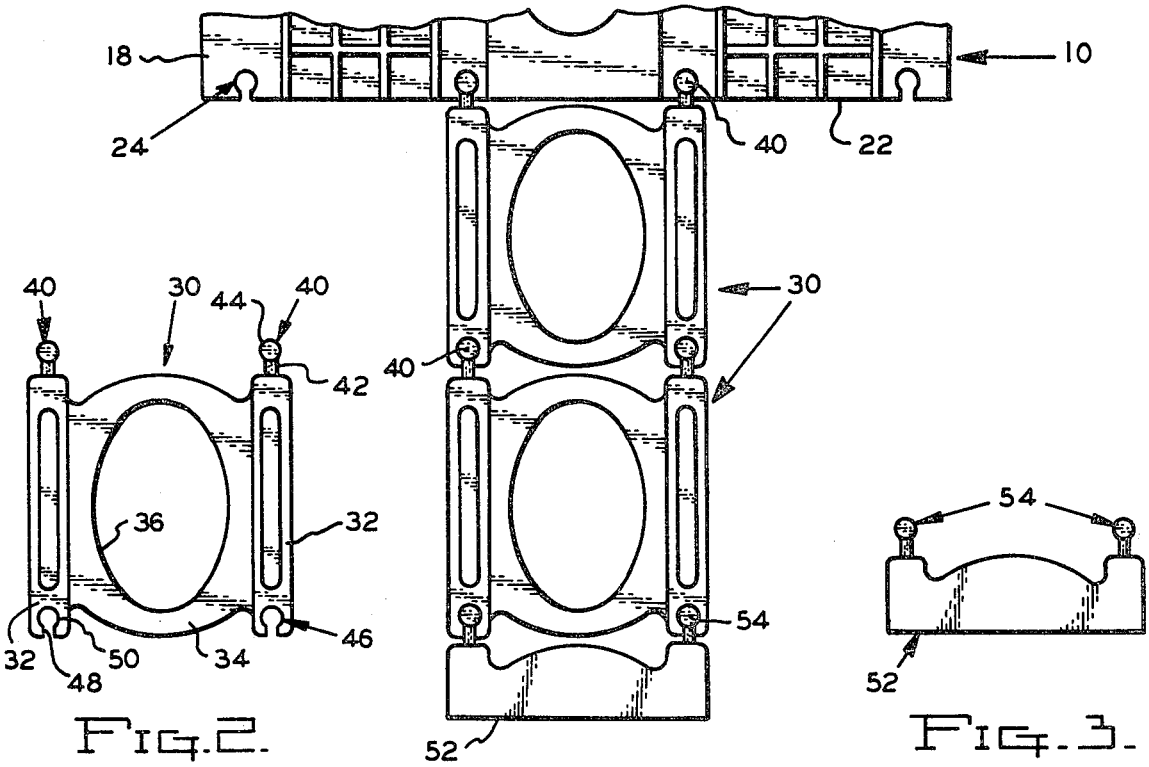
FIG. 2.
FIG. 3.
FIG. 6.
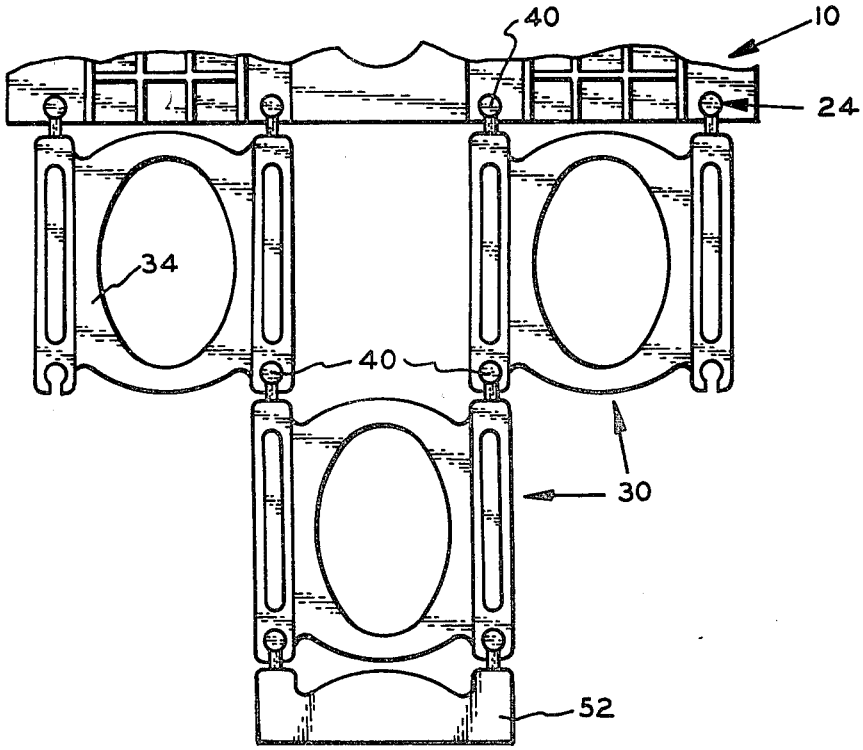
FIG. 7

MOLDED PICTURE FRAME WITH ATTACHABLE DISPLAYS

BACKGROUND OF THE INVENTION

In the displaying of photographs it is often desired to display the photographs in groups wherein individual members of a family may be displayed in proximity to each other, or several photographs of the same individual are displayed.

In the mounting of photograph displays and frames it is known to interconnect a plurality of frames, and a variety of connectors and supports have been used for this purpose, typical arrangements being shown in U.S. Pat. Nos. Des. 187,377; 3,117,672; 3,339,302; 3,529,374; 3,673,724; 4,017,989 and 4,115,938. In such prior art displays individual frames may be randomly interconnected for artistic purposes, but an order or sequence of photographs is not readily produced. Also, prior art photograph display frames capable of being interconnected are of a relatively complex and expensive construction, and not readily packaged.

It is an object of the invention to provide an attractive and inexpensive photograph display apparatus capable of displaying a plurality of photographs in an ordered or sequential manner. In particular, the device of the invention is particularly suitable for displaying the photographs of children annually taken as part of a school program wherein each year a new photograph may be readily added to the display, and the display is capable of accomodating sufficient photographs taken throughout the school years.

Another object of the invention is to provide an attractive photograph display device wherein a plurality of photographs may be displayed in selected patterns of arrangement.

An additional object of the invention is to provide photograph display apparatus wherein a plurality of display frames may be selectively and easily connected to and suspended from a supporting member, and additional display frames may be suspended from supported display frames in a sequential and orderly pattern.

In the practice of the invention a molded plaque of generally planar, but limited three-dimensional configuration, is utilized as a support member capable of being supported upon a wall. The plaque includes a lower edge with which a plurality of connectors in the form of keyhole configuration openings intersect. The keyhole openings are equally spaced from adjacent openings wherein any two adjacent openings comprise a modular set and in the preferred embodiment four keyhole openings are defined in the support member.

The photograph display frames are of such size as to accomodate a single photograph, and each includes upper and lower sets of connectors. The upper set of connectors comprise headed projections capable of being received within the keyhole openings, while the lower set of connectors for each display frame comprise a pair of keyhole shaped openings corresponding to those formed in the plaque. Thus, display frames may be selectively connected to the sets of plaque openings, and display frames may also be suspended from each other in a "chain" effect.

BRIEF DESCRIPTION OF THE DRAWINGS

The aforementioned objects and advantages of the invention will be appreciated from the following description and accompanying drawings wherein:

FIG. 1 is an elevational view of the support member plaque having a single display frame attached thereto, FIG. 2 is an elevational view of a display frame, unattached, FIG. 3 is an elevational view of a name plate or indicia member, FIG. 4 is an elevational sectional view through a connector opening and projection as taken along Section IV—IV of FIG. 1, FIG. 5 is an elevational section of a display frame as taken along Section V—V of FIG. 1, FIG. 6 is a partial, elevational view of the support member illustrating two display frames attached thereto in a symmetrical pattern, FIG. 7 is a partial, elevational view illustrating the manner whereby three display frames may be attached to the support member, and FIG. 8 is a partial, elevational view illustrating four display frames suspended from the support member plaque.

DESCRIPTION OF THE PREFERRED EMBODIMENT

With reference to FIG. 1, the primary support member for the display frames is indicated at 10, and this support member is in the form of a generally planar plaque which is formed by molding, and is of a limited three-dimensional construction. The plaque 10 represents a schoolhouse having windows indicated at 12, roof portions 14, and a bell tower 16. The aforementioned portions preferably extend from the plane of the main plaque body 18 in the direction of the viewer, and the plaque is preferably molded of a synthetic plastic material of high strength and rigidity such as a high impact styrene. A central opening 20 defined in the plaque constitutes a photograph receiving portion, and means are defined on the back of the plaque, not shown, such as a hole or a hook, whereby the plaque may be mounted upon a vertical wall.

The plaque includes a lower edge 22, of linear configuration, and four openings 24 are defined therein. Each opening is of a keyhole configuration including a narrow throat portion 26 which intersects the lower edge, and an enlarged cylindrical portion 28. The openings 24 are equally spaced with respect to the adjacent openings wherein any two adjacent openings constitute a modular set, and as will be later appreciated, this equal spacing is necessary in order to provide the selective mounting of the display frames to the plaque.

The photograph display frames 30 are each of identical configuration, and are also preferably formed of a molded synthetic plastic material of a hard and rigid nature, and the frames, while generally planar, have a three-dimensional form as will be appreciated from FIG. 5. The frames include vertically extending lateral portions 32 which arise from the general planar body 34 in the direction of the viewer, and a central photograph receiving opening 36 is defined in each frame 30. Decorative embossments 38 are formed on lateral portions 32.

The upper regions of each frame 30, as an extension of the lateral portions 32, include projections 40 which include a neck portion 42, and an enlarged cylindrical head 44. The dimension of the neck and head is slightly less than the throat 26 and portion 28 of the support member openings 24 wherein the projections 40 may be snugly received within the openings 24 to attach a frame to the support member 10 as shown in FIG. 1.

At the lower ends of the lateral portion 32 keyhole shaped openings 46 are defined having a throat 48 and a cylindrical portion 50 corresponding in dimension to those of the plaque openings 24, permitting the projections 40 of a display frame 30 to be received therein. As will be appreciated from FIGS. 1 and 2, the projection 40 and the opening 46 formed in a common display frame lateral portion 32 are in vertical alignment with each other, and the horizontal spacing between the projections 40 and openings 46 of a common frame are equal, and correspond to the spacing between the openings 24 defined in the support member plaque 10.

The indicia or name plate member 52 shown in FIG. 3 also includes headed projections 54 corresponding in configuration and spacing to projections 40 of the display frames, and the child's name, or other information, may be placed thereon.

In use, when it is desired to display only a single photograph the plaque 10 may be used alone, the photograph being loacted within the central opening 20. When two photographs are to be displayed one display frame 30 is employed, the photograph 56, FIG. 5, being mounted within the opening 36, and the single display frame would normally be centrally mounted to the plaque 10 within the central openings 24, as shown in FIG. 6.

When it is desired to display three photographs a pair of frames 30 are used, and may be interconnected as shown in FIG. 6, the member 52 being attached to the lowermost frame, or, two frames may be directly mounted side-by-side to the plaque 10 by using all of the openings 24.

FIG. 7 illustrates a symmetrical manner for attaching three frames 30 to the plaque 10, and FIG. 8 illustrates four frames 30 suspended from the plaque. Accordingly, it will be appreciated that a considerable number of frames 30 may be suspended from the plaque 10 and symmetrically arranged thereto in view of the modular manner that the display frames are attached to the plaque, and to each other.

The display apparatus of the invention is particularly suitable for displaying the annual photographs of school children, a new display frame 30 being added each year, and the molded construction of the plaque 10, and picture frames 30, permit adequate display components to be available at a reasonable cost to display many photographs.

It is appreciated that various modifications to the inventive concepts may be apparent to those skilled in the art without departing from the spirit and scope of the invention. For instance, the means for interconnecting the plaque and picture frames may vary from the keyhole and headed projection forms illustrated, and the plaque may take a form other than the schoolhouse representation.

I claim:

1. Photograph display apparatus comprising, in combination, a primary support member adapted to be supported on a vertical wall having a general plane of configuration, a vertical center axis, and including a lower edge, at least four spaced first connectors defined on said support member at said lower edge, the spacing between adjacent first connectors being equal whereby each two adjacent connectors define a set of connectors, the set of connectors nearest said vertical axis being horizontally disposed on opposite sides of said vertical axis an equal distance, a plurality of photograph display frames each having upper and lower portions, lateral sides, and a photgraph receiving portion, said display frames having a horizontal width no greater than one half of the horizontal width of said primary support member, a pair of second connectors defined on each frame at said upper portion thereof in horizontal spaced relation forming a set and a pair of third connectors defined on each frame at said lower portions thereof in horizontal spaced relation forming a set, said second connectors defined upon a display frame being vertically oriented directly above and in alignment with said third connectors defined upon the associated frame and adjacent the lateral sides of the associated display frame, the spacing between said second connectors comprising a set and the spacing between said third connectors comprising a set being equal and equal to the spacing between said first connectors whereby photograph display frames may be selectively connected to said first connector sets by said second connectors in a variety of locations with respect to said lower edge including in alignment with said vertical axis and on opposite horizontal sides of said vertical axis, and vertically adjacent display frames may be interconnected by said second and third connectors thereof.

2. In a photograph display apparatus as in claim 1, said primary support member comprising a wall supported plaque and said lower edge being substantially horizontally disposed, said display frames being identical and each being of a horizontal width less than one half of the horizontal width of said primary support member.

* * * * *